United States Patent [19]

Peterson et al.

[11] 4,159,714

[45] Jul. 3, 1979

[54] FOOTSTOOL

[75] Inventors: Samuel F. Peterson, Chicago; Clifford E. Grube, Niles, both of Ill.

[73] Assignee: Associated Mills, Inc., Chicago, Ill.

[21] Appl. No.: 855,609

[22] Filed: Nov. 29, 1977

[51] Int. Cl.[2] ..... A61H 21/00; A61H 1/00

[52] U.S. Cl. ..... 128/24.2; 128/25 B; 128/33

[58] Field of Search ..... 128/33, 25 B, 24.1, 128/24.2

[56] References Cited

U.S. PATENT DOCUMENTS

| | | | |
|---|---|---|---|
| 2,674,993 | 4/1954 | Harrell | 128/33 |
| 2,683,453 | 7/1954 | Tong | 128/33 |
| 2,694,394 | 11/1954 | Miller | 128/33 |
| 3,019,786 | 2/1962 | Krauss | 128/33 |
| 3,042,025 | 7/1962 | Jackson | 128/33 |
| 3,173,415 | 3/1965 | Rubin | 128/33 |
| 3,203,415 | 8/1965 | Moore | 128/33 |
| 3,322,117 | 5/1967 | McCaw | 128/33 |

*Primary Examiner*—Lawrence W. Trapp

*Attorney, Agent, or Firm*—Allegretti, Newitt, Witcoff & McAndrews

[57] ABSTRACT

An improved footstool has a heating element and a vibrating element in a cushion and adapts for use in a plurality of configurations. The cushion is releasably fastened to a base of the footstool for use alone, and the legs of the footstool retract for use of the footstool in an inclined position as well as an upright position.

3 Claims, 10 Drawing Figures

Fig. 1
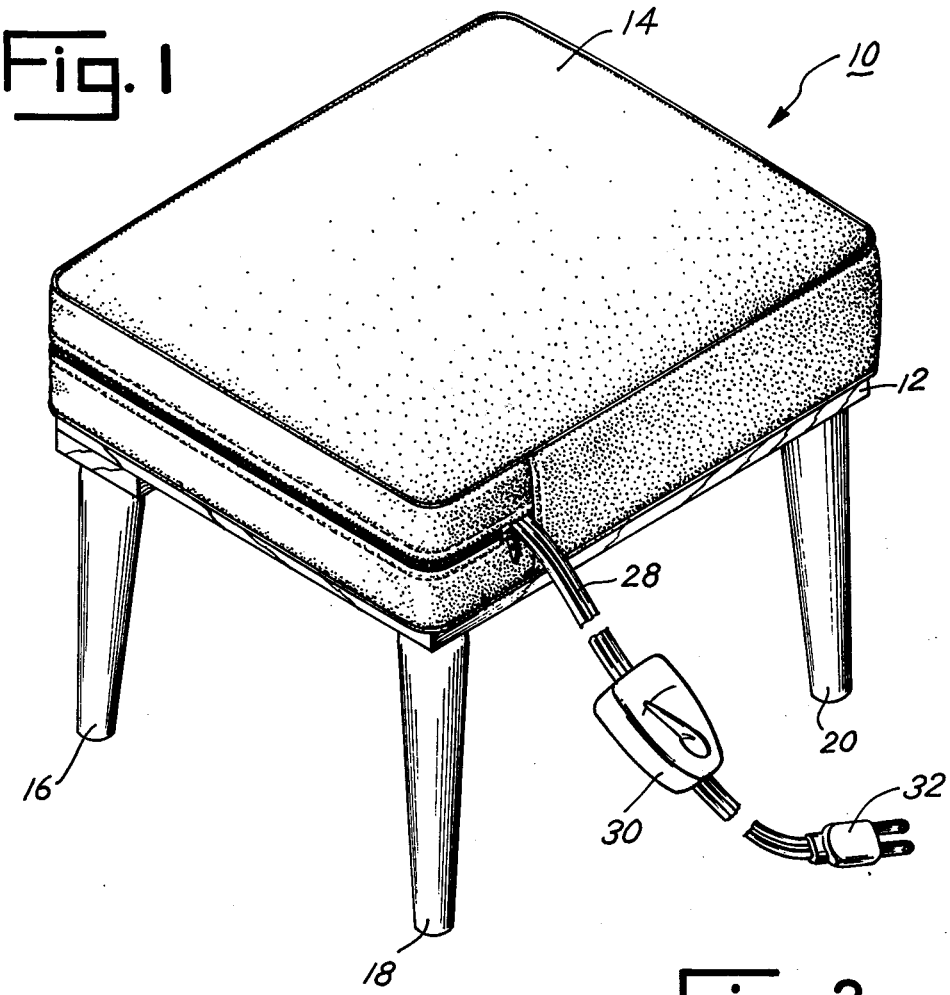
Fig. 2
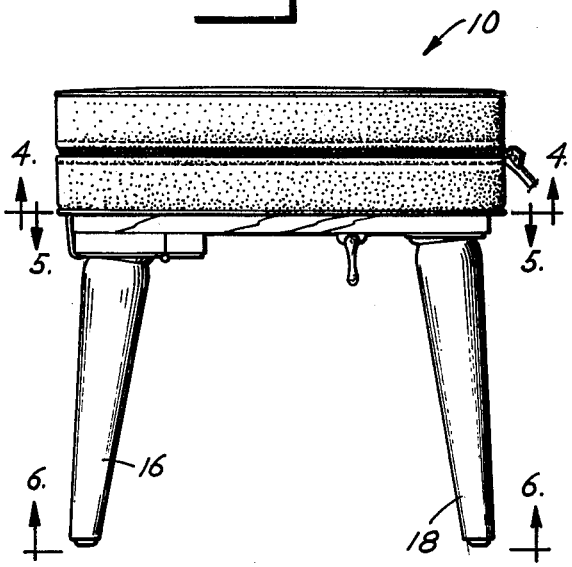
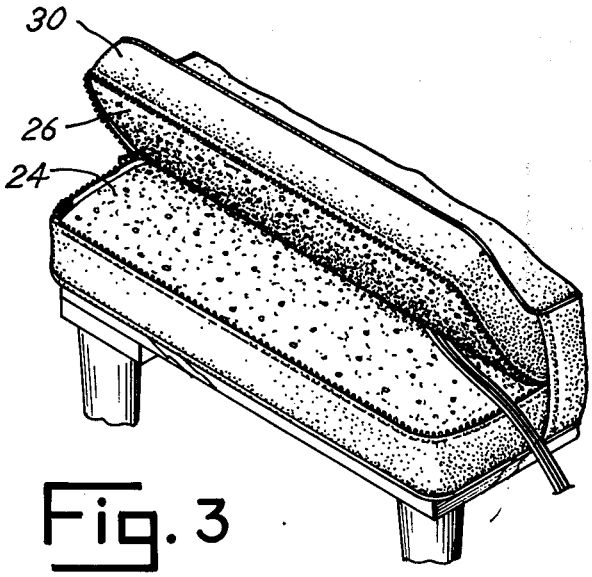
Fig. 3

FOOTSTOOL

BACKGROUND OF THE INVENTION

This invention relates to a personal comfort device and more particularly, to an improved footstool having a heating element and a vibrating element that adapts for use in a plurality of configurations.

As well known to the general public, a variety of electrical and electromechanical heating and vibrating elements, or mechanisms, have been developed commercially to aid in the medical treatment of injured back muscles and to provide general relief for other weakened or aching muscles. In the past, such elements have been incorporated into personal comfort devices such as pads known colloquially as "heating pads", and into hospital beds and lounging chairs. While such devices have been useful, each has its limitations. For example, the bed and chair are incapable of localized use, as on the soles of the feet or on the upper or lower back alone. Moreover, the heating pad, when used in other than the prone position, lacks sufficient internal rigidity to provide the support necessary for weakened back muscles. In sum, little or no consideration has been given in the past to providing one personal comfort device which adapts to all the positions and configurations in which such a device is useful.

SUMMARY OF THE INVENTION

It is thus an object of the present invention to provide a personal comfort device having a heating element and a vibrating element that lacks the limitations of prior art devices. Another object of the present invention is to provide a device that is capable of localized use, as for example on the upper or lower back or the soles of the feet.

Another object of the present invention is to provide a device which adapts for use in a plurality of configurations.

Another object of the present invention is to provide a device which adapts for use in an inclined position so that the back or feet of a user may rest thereon in the inclined position.

Another object is to provide a device that supports the back of the user in the inclined position.

Another object is to provide a device in which the heating and vibrating elements are incorporated into a pad or cushion that is portable, for use wherever desired.

A further object of the present invention is to provide such a device in the basic configuration of a footstool that has a pleasing appearance in the home.

A still further object of the present invention is to provide such a device that can be massproduced at a commercially acceptable cost.

Therefore, in a principal aspect, the present invention is a footstool comprising a rigid substantially flat base having a top and a bottom; a plurality of leg members, at least two of said leg members rigidly attached to said bottom in an extended position and the remainder of said leg members hingedly mounted on said bottom for rotation between an extended position and a retracted position, said leg members cooperating when said remainder are in said extended position to support said base in a substantially horizontal position and cooperating when said remainder are in said retracted position to support said base in a position inclined from said horizontal position; means on said base for releasably fastening said remainder in said extended position; a cushion on said top having an upper section and a lower section; cooperative means defined on said top and on said lower section for releasably fastening said cushion to said base; an electrically operated vibrating element mounted between said upper section and said lower section; an electrically operated grid-type heating element mounted on said upper section; and a manually operated means for controlling said heating element and said vibrating element, said control means having at least a heating mode, a vibrating mode, a heating and vibrating mode and an off mode, said control means in said heating mode permitting electrical current to flow to only said heating element, in said vibrating mode permitting electrical current to flow to only said vibrating element, in said heating and vibrating mode permitting electrical current to flow to both said heating element and said vibrating element, and in said off mode preventing electrical current from flowing to either said vibrating element or said heating element; whereby said pillow may be used alone, on said base in said horizontal position and on said base in said inclined position to heat, massage or simultaneously heat and massage a localized portion of the body.

BRIEF DESCRIPTION OF THE DRAWING

The preferred embodiment of the present invention will be described in relation to the accompanying drawing, wherein:

FIG. 1 is a perspective view of a preferred embodiment of the present invention;

FIG. 2 is a side view of the preferred embodiment;

FIG. 3 is a partial perspective view of the preferred embodiment similar to FIG. 1;

DETAILED DESCRIPTION OF THE PREFERRED EMBODIMENT

Figure 4:
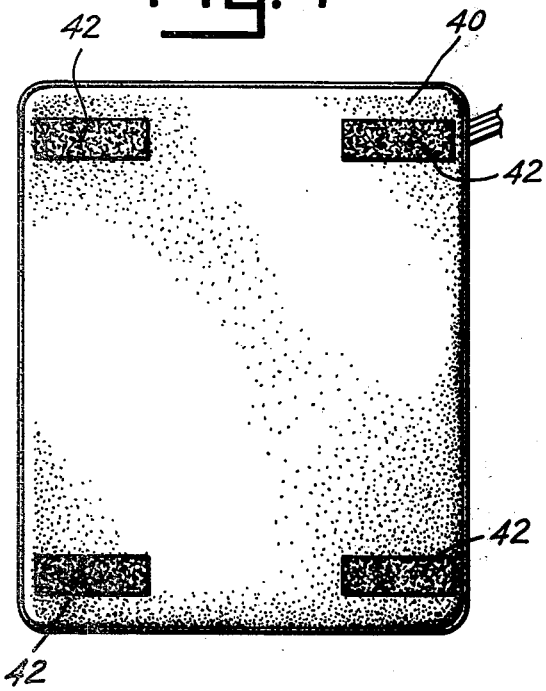
FIG. 4 is a cross-sectional view of the preferred embodiment view taken along line 4—4 of FIG. 2.

Referring to the drawing, the footstool 10 of the preferred embodiment includes a substantially rectangular, flat base 12, a cushion or pillow 14 atop the base 12 and four tapered legs 16, 18, 20, 22 attached to the base 12. A grid-type heating element 60 is secured atop a top layer 26 of foam rubber padding under the vinyl sewn cover 30 of the cushion or pillow 14, and a vibrating element 80 is centered between the top layer 26 and a bottom layer 24. The cover 30 is zippered along a side 34 thereof for ease of assembly of the cushion 14, and for access to the heating element 60 and the vibrating element 80.

Figure 5:
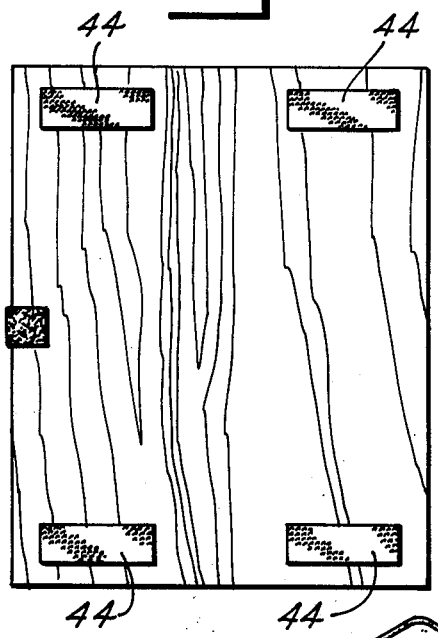
FIG. 5 is a cross-sectional view of the preferred embodiment taken along line 5—5 of FIG. 2.

As shown in FIGS. 4 and 5, the bottom 40 of the cover 30 has four nylon fastening strips 42 spaced about the corners thereof, and the wooden base 12 has four mating nylon fastener strips 44 spaced thereabout for cooperation with the fastening strips 42. As well known, strips 42, 44 are available under the commercial name of Velcro manufactured by the Velcro Corporation of New York, N.Y. As employed on the bottom 40 and the base 12, the strips 42, 44 releasably fasten the cushion 14 for use atop the base 12 and for use alone.

Figure 6:
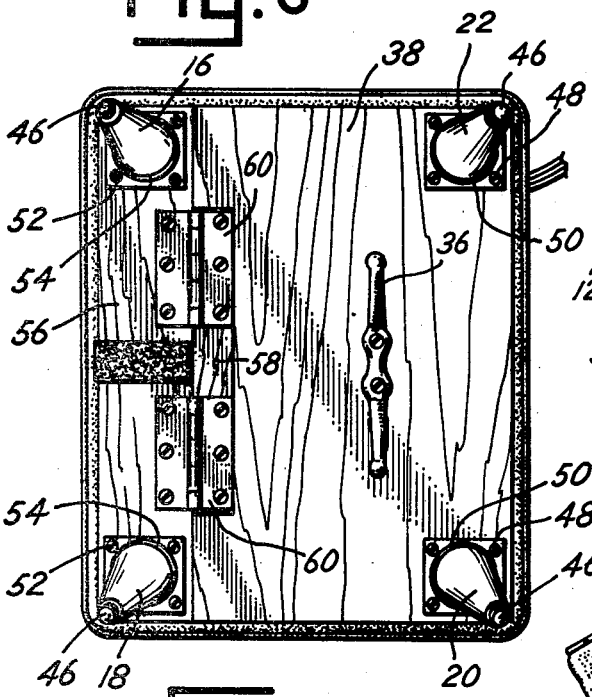
FIG. 6 is a bottom plan view of the preferred embodiment.
Figure 7:
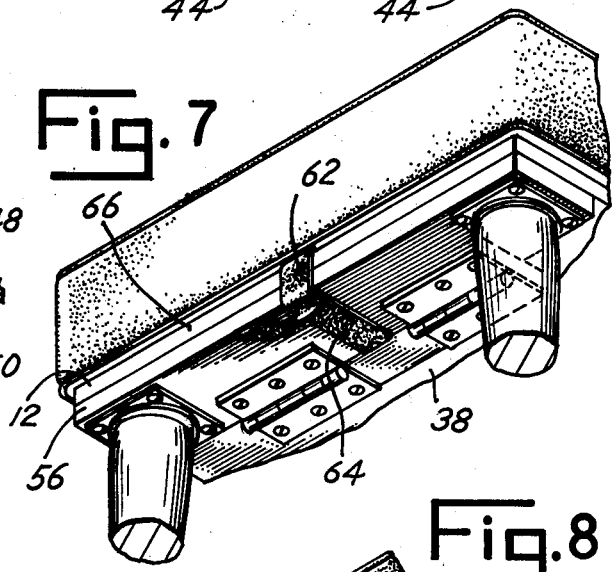
FIG. 7 is a partial perspective view of the preferred embodiment as seen from below.

Referring now to FIGS. 2 and 6–8, the legs 16, 18, 20, 22 are turned from wood and each has a metal foot or tip 46 on the bottom. On the top, each has an axially extending metal mounting screw (not shown). The legs 20, 22 are screwed into identical metal mounting brackets 48 that each have an inclined mounting face 50 to skew the legs 20, 22 outward from the vertical, when mounted, for increased stability. As shown in FIGS. 6 and 7, the mounting brackets 48 are screwed directly into the bottom surface 38 of the base 12.

The legs 16, 18 are also screwed into mounting brackets 52 which each have an inclined mounting face 54 that skews the legs 16, 18 outward. However, the mounting brackets 52 are screwed onto a wooden cross-piece 56 that extends across a portion of the bottom 38 of the base 12.

The cross-piece 56 is hingedly attached to a wooden hinge support piece 58 by metal strip hinges 60. The hinges 60 are screwed to the cross-piece 56 and through the hinge support piece 58 to the base 12. The legs 16, 18 are thus hingedly mounted on the base 12 for rotation between an extended position and a retracted position.

In the extended position, the legs 16, 18, which are shortened from the legs 20, 22 by the width of the cross-piece 56, cooperate with the legs 20, 22 to support the base 12 in an upright position. Thus the footstool 10 may be used as a conventional footstool, placed to prop the backs of the feet of a seated person. A nylon strip fastening section 62 is attached to the base 12 near the midpoint of the side 66 thereof to cooperate with a mating nylon strip section 64 and releasably secure the legs 16, 18 in the extended position.

Figure 8:
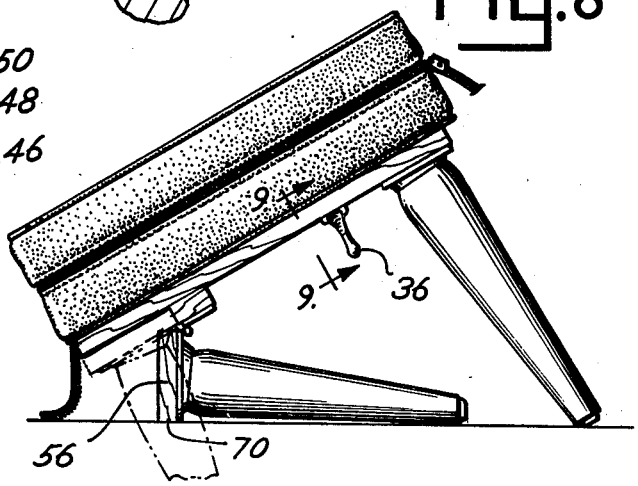
FIG. 8 is a side view of the preferred embodiment similar to FIG. 2, depicting the folding legs in a retracted position.

In the retracted position, the legs 16, 18 cooperate with the legs 20, 22 to support the base 12 in a position tilted or inclined from the horizontal, as shown in FIG. 8. The legs 16, 18 retract inward toward the legs 20, 22 and the side 70 of the cross-piece 56 lies in a horizontal plane to support the base 12. As shown, the side 70 and the tips 46 of the legs 20, 22 lie along parallel lines for stability.

Figure 10:
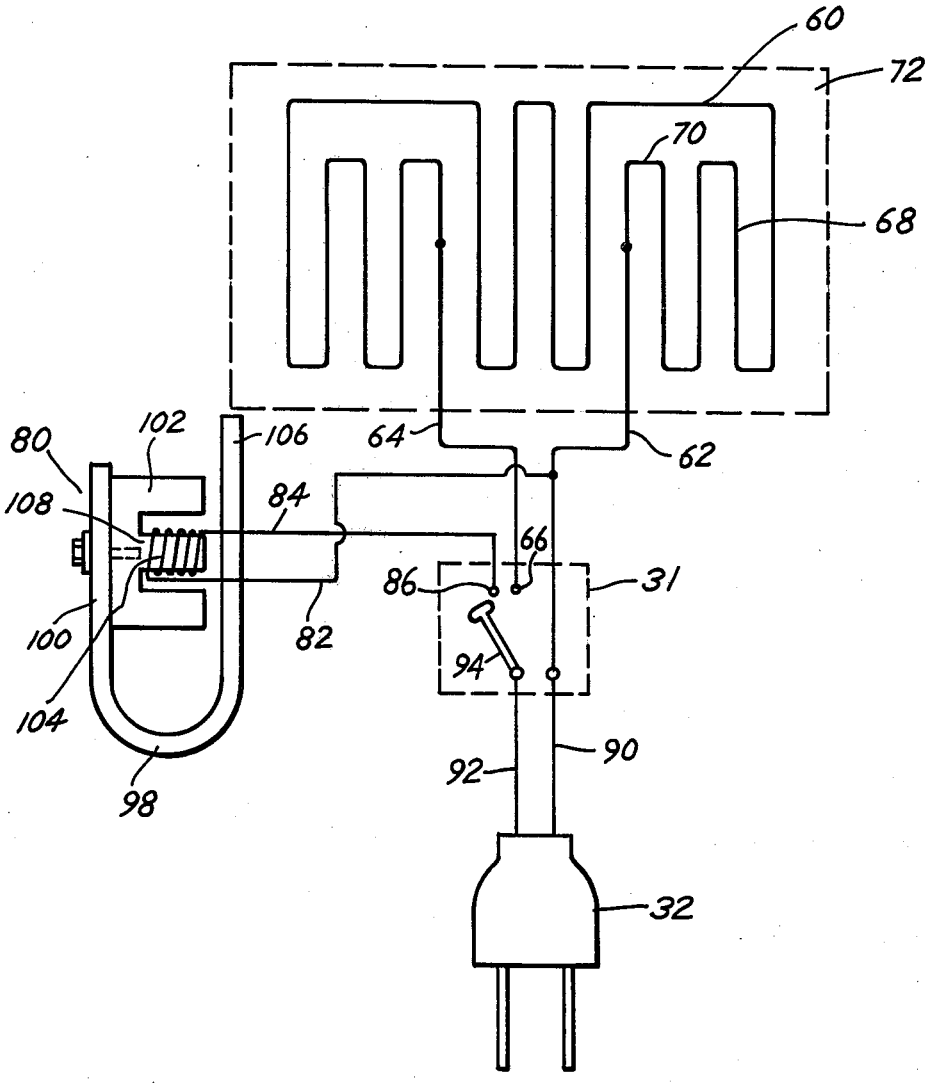
FIG. 10 is a diagram of the circuit of the preferred embodiment.

Referring to FIGS. 1 and 10, the heating element 60 and the vibrating element 80 are electrically connected via an electrical power cord 28 to a control unit 31 and to a plug 32. The plug 32 is adapted to be connected to an electrical outlet or socket (not shown) to supply 110-volt electrical current to the elements 60, 80.

More specifically, the heating element 60 is connected by a wire 62 to a grounded wire 90 of the plug 32, and the vibrating element 80 is connected to the ground wire 90 by a wire 82. Current is supplied to the elements 60, 80 by wires 64, 84, respectively, and each wire 64, 84 is attached to a contact pin 66, 86.

Figure 9:
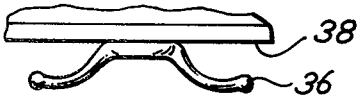
FIG. 9 is a partial cross-sectional view taken along line 9—9 of FIG. 8.

As preferred, the control unit 31 is a manually operated switch having four operating positions, including a "Heat" position, a "Massage" position, a "Heat Plus Massage" position, and an "Off" position. These four positions are defined by a T-shaped switch member 94 which is connected to the power wire 92 of the plug 32. In the "Heat" position, the switch member 94 contacts the pin 66 only, and thereby permits electrical current to flow to only the heating element 60. In the "Massage" position the switch member 94 contacts the pin 86 only, and thereby permits electrical current to flow to only the vibrating element 80. In the "Heat Plus Massage" position the switch member contacts both the pins 66, 86; and in the "Off" position, it contacts neither of the pins 66, 86, thereby turning off the elements 60, 80. When the elements 60, 80 are not in use the cord 28 may be wrapped about a hook 36 screwed to the bottom 38 of the base 14, as shown in FIGS. 6 and 9.

The heating element 60, as shown in FIG. 10, includes a plurality of loops 68 of wire 70 glued to a vinyl backing sheet 72. When 110-volt current is supplied to the wire 70, it heats to a comfortable temperature and remains in that state.

The vibrating element 80 includes two saucer-shaped steel disks (not shown) bolted together in a face-to-face relationship. Spot-welded to the inner surface of one disk is the fixed end 106 of a steel U-shaped, vibrating member 98. Bolted to the inner side of the free end 100 of the vibrating member 98 is a three-pole electromagnet 102. A coil of wire 104 is wound about the center pole 108 of the electromagnet 102 and connected to the wires 82, 84. As 110-volt alternating current passes through the coil 104, the polarity of the electromagnet 102 alternates and the fixed end 106 of the vibrating member 98 vibrates in relation to the free end 100. Thus the disks of the vibrating element 80 vibrate, as does the cushion 14.

The footstool 10 thus described may be used in a plurality of configurations. With the base 12 horizontal, the configuration is that of a conventional footstool. With the base 12 inclined, the configuration is that of an inclined foot rest suitable for comforting the soles of the feet. In this configuration, the footstool may also be used as a back rest when placed atop a bed. Finally, with the cushion 14 removed, the cushion 14 can be used as a heating pad where desired.

From the foregoing, it should be apparent to those having skill in the art that modifications or changes could be made in the design of the footstool described herein. Thus the preferred embodiment of the present invention is to be considered in all respects as illustrative and not restrictive. All changes which come within the meaning and range of equivalency of the claims are intended to be embraced therein.

What is claimed is:

1. A footstool comprising in combination:

a rigid substantially flat base having a top and a bottom;

a plurality of leg members, at least two of said leg members rigidly attached to said bottom in an extended position and the remainder of said leg members hingedly mounted on said bottom of said base for rotation between an extended position and a retracted position, said leg members cooperating when said remainder are in said extended position to support said base in a substantially horizontal position and cooperating when said remainder are in said retracted position to support said base in a position inclined from said horizontal position;

means on said base for releasably fastening said remainder in said extended position;

a cushion on said top having an upper section and a lower section;

cooperative means defined on said top and on said lower section for releasably fastening said cushion to said base;

an electrically operated vibrating element mounted between said upper section and said lower section;

an electrically operated grid-type heating element mounted on said upper section; and a manually operated means for controlling said heating element and said vibrating element, said control means having at least a heating mode, a vibrating mode, a heating and vibrating mode and an off mode, said control means in said heating mode permitting electrical current to flow to only said heating element, in said vibrating mode permitting electrical current to flow to only said vibrating element, in said heating and vibrating mode permitting electrical current to flow to both said heating element and said vibrating element, and in said off mode preventing electrical current from flowing to either said vibrating element or said heating element;

whereby said cushion may be used alone, on said base in said horizontal position and on said base in said inclined position to heat, massage or simultaneously heat and massage a localized portion of the body.

2. The footstool of claim 1 including a cross-piece to which said remainder of said leg members are attached, said cross-piece being hingedly attached to said bottom and having a side that lies in a horizontal plane and supports said base when said remainder are in said retracted position.

3. The footstool of claim 2 wherein said side has a pre-selected width and said remainder of said leg members include two legs which have a length equal to the length of said two leg members minus the width of said side.

* * * * *